US005173243A

United States Patent [19]

Laszlo

[11] Patent Number: 5,173,243

[45] Date of Patent: Dec. 22, 1992

[54] SLAG CONTROL METHOD AND APPARATUS

[75] Inventor: William S. Laszlo, Lockport, Ill.

[73] Assignee: Industrial Maintenance and Contract Services Limited Partnership, Munster, Ind.

[21] Appl. No.: 560,598

[22] Filed: Jul. 31, 1990

[51] Int. Cl.[5] ..... B22D 41/04

[52] U.S. Cl. ..... 266/45; 266/240; 266/231

[58] Field of Search ..... 266/45, 240, 231, 201, 266/205, 230; 222/591, 590

[56] References Cited

U.S. PATENT DOCUMENTS

| | | | |
|---|---|---|---|
| 666,373 | 1/1901 | Baker | 266/230 |
| 1,572,864 | 2/1926 | McKune | 266/231 |
| 1,590,739 | 6/1926 | Evans | 266/230 |
| 1,690,748 | 11/1928 | Moyer | 266/230 |
| 2,528,571 | 11/1950 | Babcock et al. | 266/240 |
| 2,704,248 | 3/1955 | Madaras | 266/230 |
| 3,905,589 | 9/1975 | Schempp | 266/227 |
| 4,390,169 | 6/1983 | LaBate | 266/231 |
| 4,444,378 | 4/1982 | Reese et al. | 266/240 |
| 4,639,927 | 1/1987 | Uno | 266/230 |

*Primary Examiner*—Scott Kastler

[57] ABSTRACT

Method and apparatus for controlling slag in a tilting furnace is provided. The apparatus comprises a discharge trough, lateral opening, dam, weir, discharge passage, discharge passage gate, and slag gate. The method comprises tilting the furnace to discharge molten metal and slag into the discharge trough, damming and retaining slag in the discharge trough while allowing molten metal to flow through the discharge passage and out of the discharge trough, closing the discharge passage with the discharge passage gate, and opening the slag gate to allow slag to flow out of the discharge trough the lateral opening.

19 Claims, 10 Drawing Sheets 15
59
69
61
60
76
68
66
67
65
63
62
64
78
10
11
25
77
10
10

SLAG CONTROL METHOD AND APPARATUS

TECHNICAL FIELD

The present invention relates generally to a method and apparatus for removing slag that separates from molten metal, and more particularly to a method and apparatus for removing slag that separates from molten metal which is discharged from a tilting electric arc furnace.

BACKGROUND OF THE INVENTION

When scrap metal is heated to a liquid, molten state, certain impurities may be separated from the molten metal by the introduction of conventional fluxes which react with the impurities to form what are conventionally known as furnace slags. These slags rise to the surface and float on top of the molten metal.

Slag is of little or no value in making use of the molten metal. To the contrary, slag can interfere with using alloy additives to make various metal specifications.

For example, in making alloy steel, soluble oxygen is an unwanted contaminant. Slag which rises to the top of molten steel contains a large amount of soluble oxygen. If slag is present when alloys are added to the molten steel, then the soluble oxygen in the slag will react with the alloys and inhibit the alloys from reacting with the molten steel. Thus, the slag inhibits the alloying process. Also, the presence of slag in the molten steel facilitates the formation of particulate inclusions which, if large enough, may be detrimental to the physical properties of the steel.

Since furnace slag is a contaminant which may have a deleterious effect on making alloy steels, it is desirable to remove the slag before alloys are added to the molten metal. Slag removal is usually done before alloys are added to the molten steel. Any slag which is removed is usually discarded. The process of removing slag from molten steel is often known as slag control.

Slag control has been a particularly difficult problem when scrap steel is melted in tilting furnaces. As discussed below, there have been numerous attempts at controlling slag which separates from molten steel that is discharged from a tilting furnace.

The typical tilting furnace is mounted on a tilting platform. A tap hole is located on the side of the furnace. A trough is mounted on the side of the furnace, just below the tap hole.

When the furnace is heated, scrap steel in the furnace melts into a molten liquid state. Slag will separate from the molten steel and float in a separate layer on top of the molten steel. The level of the floating slag is usually kept below the level of the tap hole when the furnace is upright.

When the furnace is tilted, the operator of the furnace will attempt to tilt the furnace sufficiently so that the molten steel flows through the tap hole and the slag floats at a level above the level of the tap hole. As the molten steel drains from the furnace, the operator increases the angle of tilt in order to keep the slag at a level above the level of the tap hole. Thus, the operator attempts to cause all of the molten steel to flow through the tap hole before the slag begins to flow through the tap hole.

While molten steel flows through the tap hole, some slag will flow with the molten steel through the tap hole when a vortex forms. The vortex draws a very fluid layer of floating slag, known as interface slag, through the tap hole while molten steel is flowing through the tap hole. This interface slag floats in a layer between the molten steel and the rest of the floating slag. It has much less viscosity, and a higher concentration of soluble oxygen, than the rest of the floating slag. It is particularly deleterious to the alloying process.

The operator cannot see the vortexing of this interface slag because the furnace is usually enclosed on all sides and the top. Therefore, there is very little that he can do to prevent this interface slag from contaminating the molten steel during the process of pouring the molten steel through the tap hole. The pouring or tapping process is conventionally known as a "tap."

Near the end of the tap, the level of the molten metal and floating slag in the furnace has fallen so that the floating slag is at the level of the tap hole inside the furnace. The floating slag will thus begin to flow through the tap hole and contaminate the molten steel which has already been poured from the furnace. At this point, the operator attempts to stop the tapping process quickly by closing the tap hole and/or returning the furnace to the upright position.

However, because a tilting furnace is usually fully enclosed, the operator usually cannot see inside the furnace to determine exactly when the slag is about to begin flowing through the tap hole. Therefore, the operator usually waits until he sees slag coming out of the tap hole and into the trough before attempting to stop the flow of slag and returning the furnace to the upright position.

Thus, the traditional method of slag control consists of closing the tap hole and/or returning the furnace to the upright position after slag is observed to begin flowing through the tap hole and in the trough. As discussed below, there have been numerous attempts to implement this basic method of slag control on tilting furnaces, including Vost-Alpine slag stoppers, the E-M-L-I system, and various tap hole gates.

The Vost-Alpine slag stopper is a large, articulating nitrogen gas cannon which is used to close the tap hole. Operating under very high pressure, the cannon discharges nitrogen gas into the tap hole of the furnace on demand, and this stops the flow of molten steel and slag through the tap hole. Thus, the Vost-Alpine slag stopper is a kind of tap hole gate.

The E-M-L-I system consists of an electronic sensor which is mounted to the furnace inside the tap hole refractory. The sensor can sense when a predetermined percentage of slag is contained in the molten metal which is flowing through the tap hole. When the predetermined percentage is sensed by the sensor, the sensor communicates this to the operator of the furnace, who will then return the furnace to the upright position. Thus, the E-M-L-I system is used to control slag by directing the operator of the furnace to stop flow through the tap hole as soon as a minimum amount of slag begins to flow through the tap hole.

A variety of mechanical tap hole gates are used to control slag. The gates have a variety of shapes including the shapes of a tetrahedron or globe (also known as "cannonball"). The gate may slide into position via a rotary mechanism.

The eccentric bottom tapping gate is another attempt at slag control in an electric arc furnace. It requires that the tap hole be made in the bottom, rather than the side, of the furnace. When the operator observes slag pouring from the furnace, he closes a sliding gate to block the tap hole and prevent further flow through the tap hole. This method of slag control is quite expensive in that it requires new furnace and ladle transfer cars or turrets to receive the molten steel tap discharge and the furnace no longer tilts. The ladles must be removed from the side of the furnace and placed underneath the bottom of the furnace.

None of these prior methods of slag control on a tilting furnace have performed particularly well. None of them solve the problem of contamination of the molten steel with slag which comes through the tap hole at the end of a tap before the operator can react to stop flow through the tap hole. None of them solve the problem of contamination of the molten steel with interface slag which vortexes through the tap hole while molten steel is flowing through the tap hole at the same time.

In the prior art known to the inventor, there is no known method or apparatus to control slag after it escapes through the tap hole of a tilting furnace. All of the prior art methods and apparati known to the inventor have simply attempted to stop flow through the tap hole when it is determined that all of the molten steel has come through the tap hole and floating slag is beginning to flow through the tap hole. None of these prior art methods and apparati control or remove the slag after it goes through the tap hole and into the trough.

It would be desirable to control slag in a tap discharge of molten metal after it flows through the tap hole and before it flows out of the trough and into the ladle, wherein the slag control apparatus tilts with a tilting electric arc furnace and positive separation and control of the slag, including interface slag, is established. Further, it would be desireable to view the level of molten metal and floating slag in the discharge trough in order to coordinate the separation, retention and discharge of the slag with the tilting of the furnace in a positive manner, with an apparatus which can be removed and replaced as necessary, without removal or replacement of the discharge trough or furnace.

SUMMARY OF THE INVENTION

This invention provides a method for controlling the amount of slag in a tap discharge of molten metal and slag from a tap hole of a tilting furnace having a discharge trough mounted to, and extending outwardly from, the furnace below the tap hole for tilting with the furnace wherein the trough has an open discharge end and a lateral opening inwardly of the discharge end. The method includes the steps of sufficiently tilting the furnace and trough to discharge the molten metal and slag from the tap hole and into the trough whereby the molten metal can flow under the influence of gravity out of the trough at the discharge end, damming and retaining the slag in the trough while permitting molten metal to flow out of the trough, and discharging the retained slag through a lateral opening to a location remote from the discharge end.

The apparatus includes a discharge trough means is mounted to, and extending outwardly from, the furnace below the tap hole. Thus, the discharge trough means tilts with the furnace. The discharge trough means has an open discharge end and a lateral opening inwardly of the discharge end.

A slag gate means is operatively disposed adjacent the lateral opening. It moves between an open position for permitting the flow of slag from the discharge trough means through the lateral opening and a closed position for occluding flow through the lateral opening.

A weir extends across the discharge trough means outwardly of the lateral opening, and a dam extends across the trough means between the lateral opening and the weir. There is a discharge passage below the top of the dam for permitting the flow of molten metal outwardly past the dam and below the top of the dam. A discharge passage gate means is operatively disposed adjacent the discharge passage. The discharge passage gate means moves between an open position for permitting the flow of molten metal through the discharge passage and a closed position for occluding flow through the discharge passage.

Features and advantages of the present invention will become readily apparent from the following detailed description, accompanying drawings, and appended claims.

BRIEF DESCRIPTION OF THE DRAWINGS

The invention is described in greater detail in the following description of the preferred embodiment, taken in conjunction with the drawings, in which.

DETAILED DESCRIPTION

Figure 1:
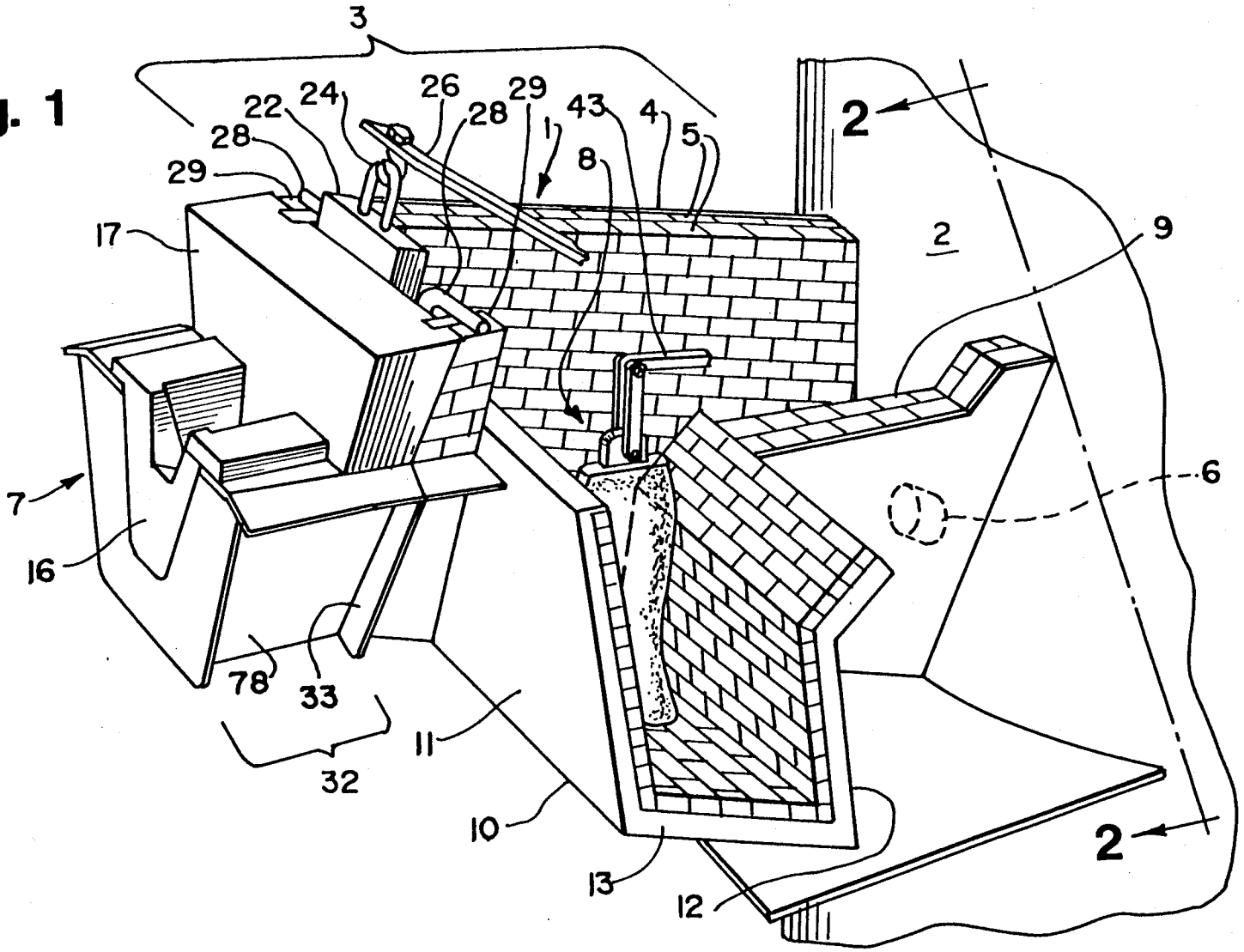
FIG. 1 is a fragmentary, perspective view showing a preferred embodiment of the slag control apparatus of the present invention with portions of the furnace and lever arms shown cut away and the fulcrum members, heat shield means, hydraulic actuators, cooling lines, extension arm, counter-balance, and control means omitted for purposes of simplification.

While the present invention may be embodied in various forms, a preferred embodiment is shown in the drawings and is described below. However, this description of a preferred embodiment is not intended to limit the scope of the invention to the disclosed embodiment.

As seen in FIG. 1, a discharge trough means 1 is mounted to, and extends outwardly from, a side of a conventional tilting electric furnace 2. The furnace is variably tiltable between a non-discharging, vertical, upright position and a final discharging position which is about 41° from vertical.

The discharge trough means 1 may be any suitable means for holding molten metal and directing it outwardly from the side of the tilting furnace 2. Preferably, the discharge trough means 1 is a steel trough 4 lined with two layers of refractory brick 5, as seen in FIGS. 1, 3, and 8A through 8D.

Figure 3:
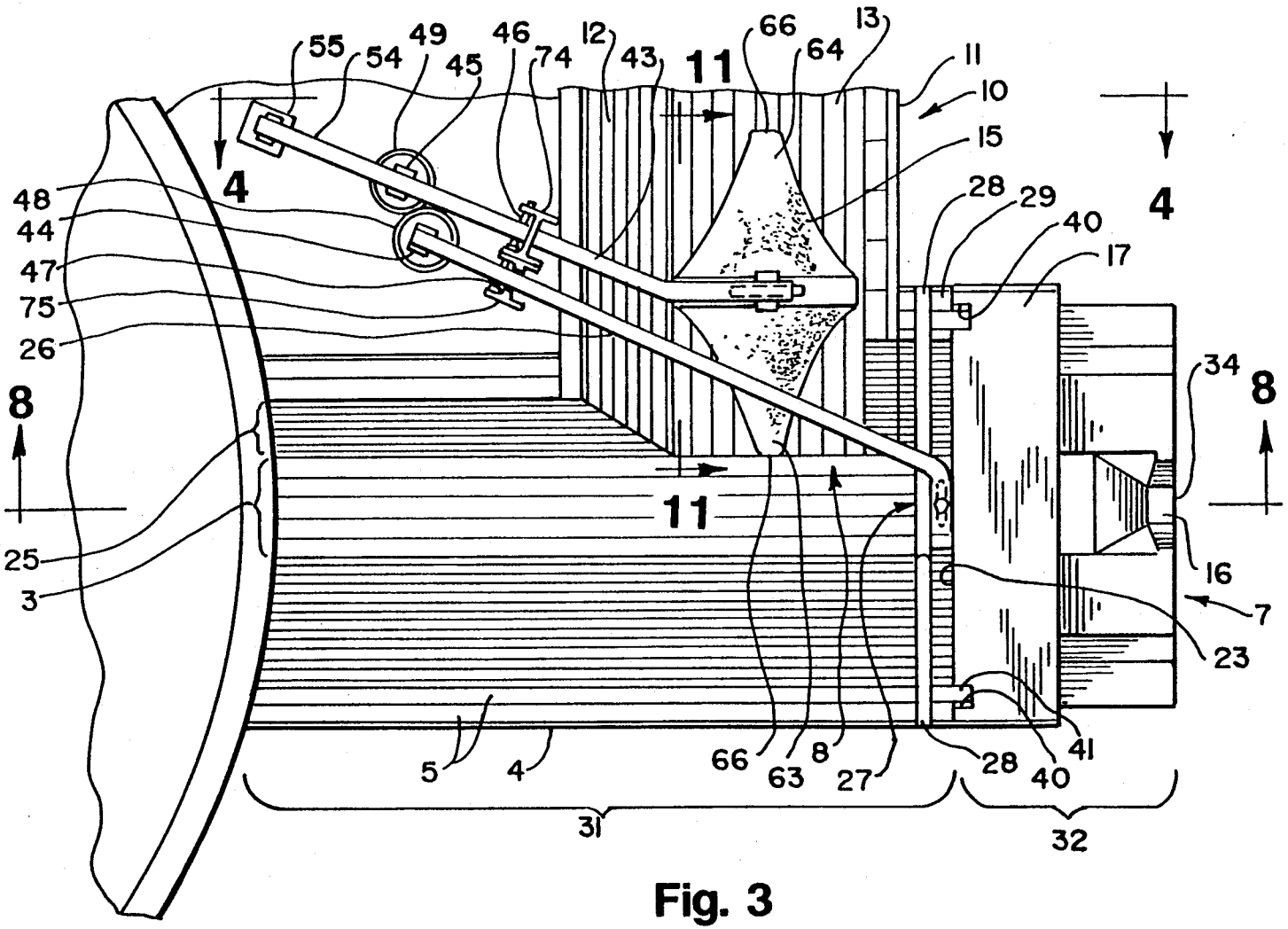
FIG. 3 is a fragmentary, top view of the slag control apparatus taken generally along the plane 3—3 in FIG. 2 with portions of the furnace shown cut away and the hydraulic lines, cooling lines and control means omitted for purposes of simplification.
Figure 4:
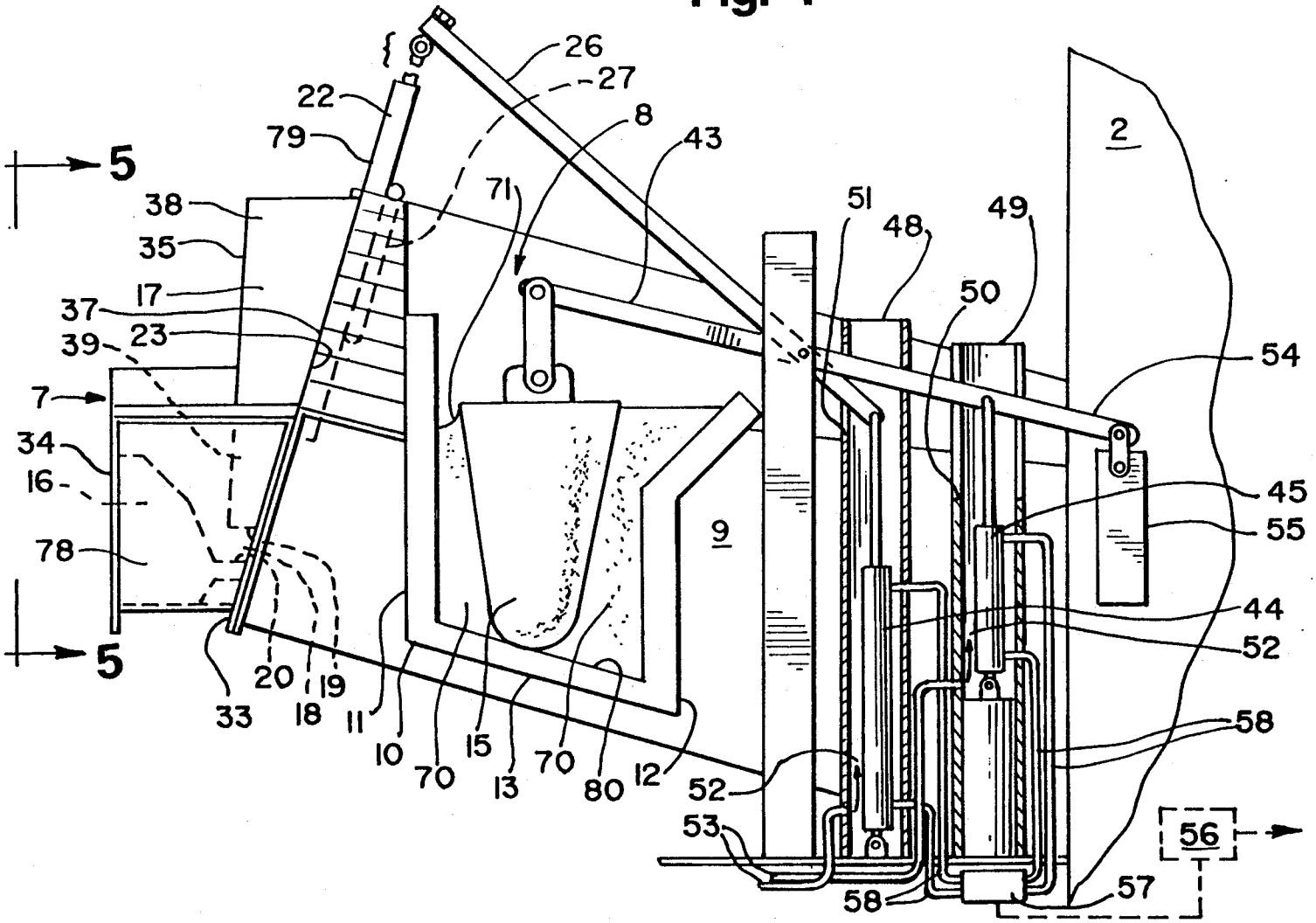
FIG. 4 is a schematic side view of the slag control apparatus taken generally along the plane 4—4 in FIG. 3, in which the hydraulic actuators and heat shield means are reoriented schematically for purposes of illustration, the heat shield means are shown in cross-section, and the hydraulic lines, cooling lines and control means are shown in elevation.

The discharge trough bottom wall 3 extends from the side of the furnace just below a tap hole 6, as seen in FIGS. 8A through 8D. Preferably, the discharge trough means 1 extends outwardly from the furnace 2 at an angle of about 15° above horizontal. The discharge trough means 1 is permanently affixed to the furnace 2 so that it will tilt along with the furnace 2. It has an open discharge end 7, and it has a lateral opening 8 in a side wall 9 inwardly of the open discharge end 7, as seen in FIGS. 1, 3 and 4.

A slag chute 10 extends outwardly from the lateral opening 8 in the side wall 9 of the discharge trough means 1, as seen in FIGS. 1, 2, 3 and 4. The slag chute 10 has two side walls 11 and 12 and a bottom wall 13. The slag chute comprises a steel chute or trough lined with refractory brick.

A slag gate means 15 is operatively disposed adjacent the lateral opening 8 as seen in FIGS. 1, 2, 3, 4 and 8A through 8D. The slag gate means 15 may be any suitable moveable gate which can restrain the flow of molten metal and a preferred embodiment is described in detail hereinafter.

The slag gate means 15 moves between an open position for permitting the flow of slag from the discharge trough means through the lateral opening 8 and a closed position for occluding flow through the lateral opening 8. The slag gate means 15 preferably slides vertically between the lowered, closed position and the raised, open position. The slag gate means 15 is shown in the lowered, closed position in FIGS. 1 through 4 and 8A through 8C and in the raised open position in FIG. 8D.

Figure 5:
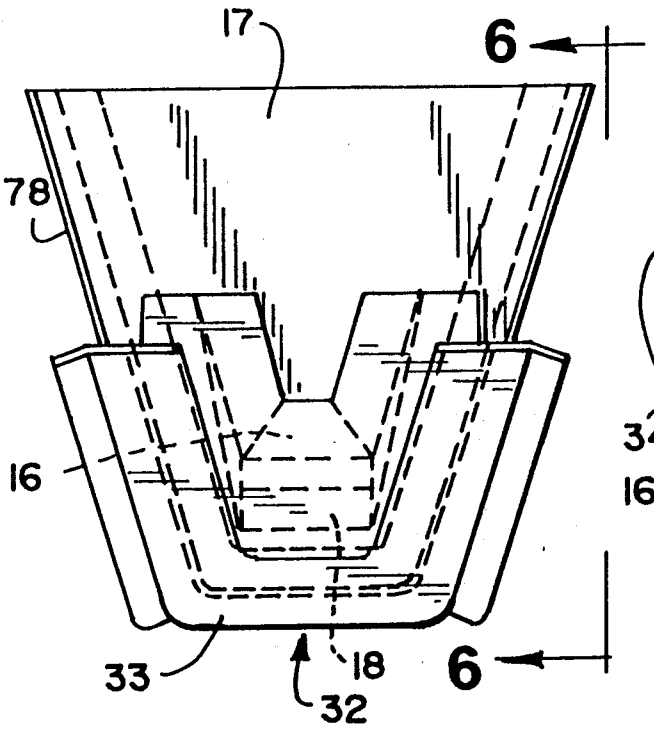
FIG. 5 is an end view of the outer trough portion taken generally along the plane 5—5 in FIG. 4.

A weir 16 extends across the width of the discharge trough means as seen in FIGS. 1, 3, 4, 5, 6 and 8A through 8D. The weir 16 is located outwardly of the lateral opening 8. Preferably, the top of the weir 16 is V-shaped, as seen in FIGS. 1 and 5.

A dam 17 extends across the width of the discharge trough means 1 as seen in FIGS. 1 through 7 and 8A through 8D. It is located between the lateral opening 8 and the weir 16.

A discharge passage 18 is located between the bottom 19 of the dam 17 and the bottom portion 20 of the discharge trough means, as seen in FIGS. 4, 5, 6, 7, and 8A through 8D. The discharge passage 18 is an opening below the dam 17 which permits the passage of liquid, molten steel 21 (e.g., FIG. 8C) which is flowing outwardly in the discharge trough means 1. Preferably, the passage 18 is approximately 10 to 15 inches wide and approximately 3 to 6 inches high. Preferably, the passage is as wide as the bottom of the discharge trough means 1. Preferably, the passage 18 is rectangular.

Preferably, the level of the bottom of the discharge passage 18 is flush with the bottom wall 3 of the discharge through means 1, as shown in FIGS. 8A through 8D, or the bottom of the discharge passage is within approximately 3 inches of the level of the bottom wall 3 of the discharge trough means 1.

A discharge passage gate means 22 is operatively disposed adjacent the inner face 23 of the dam, as seen in FIGS. 2, 3, 4 and 8A through 8D. The discharge passage gate means 22 functions to close the discharge passage to prevent the flow of molten metal through the discharge passage.

The discharge passage gate means 22 slides between a raised, open position and a lowered, closed position. When the discharge passage gate means 22 is in the raised, open position, molten metal 21 may flow through the discharge passage 18. When the discharge passage gate means 22 is in the lowered, closed position, it occludes flow through the discharge passage 18. The discharge passage gate means 22 is shown in the raised, open position in FIGS. 8A through 8C and the lowered, closed position in FIG. 8D.

Preferably the discharge passage gate means 22 is in the shape of a rectangular block with substantially planar faces. When the discharge passage gate means 22 moves up and down, the passage face 79 of the discharge passage gate means 22 slides along the adjacent inner face 23 of the dam 17, in a direction parallel to each face, as shown in FIGS. 8A through 8D.

Figure 2:
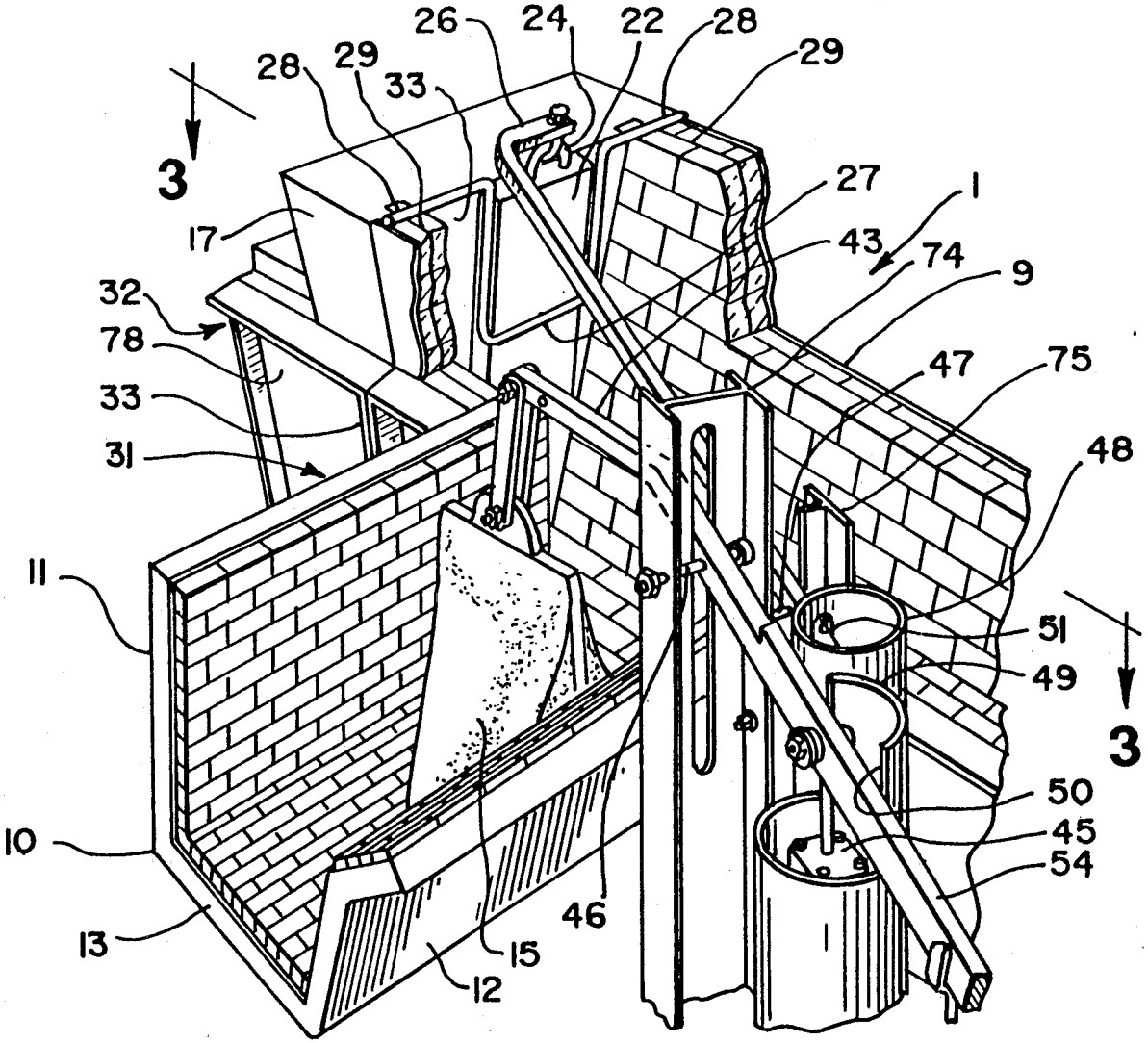
FIG. 2 is a fragmentary, perspective view of the slag control apparatus taken generally along the plane 2—2 of FIG. 1 with portions of the side walls of the discharge trough, fulcrum members, heat shield means and hydraulic actuators shown cut away and the furnace, cooling lines, hydraulic lines, counter-balance and control means omitted for purposes of simplification.

The discharge passage gate means is made by applying refractory to a mesh core (not visible in the Figures). An inverted U-shaped bar 24 extends upwardly from the top of the discharge passage gate means 22, as shown in FIGS. 1 and 2. The bar 24 serves as a connector to a lever arm 26 from which the discharge passage gate means 22 is suspended and operated.

Figure 8A:
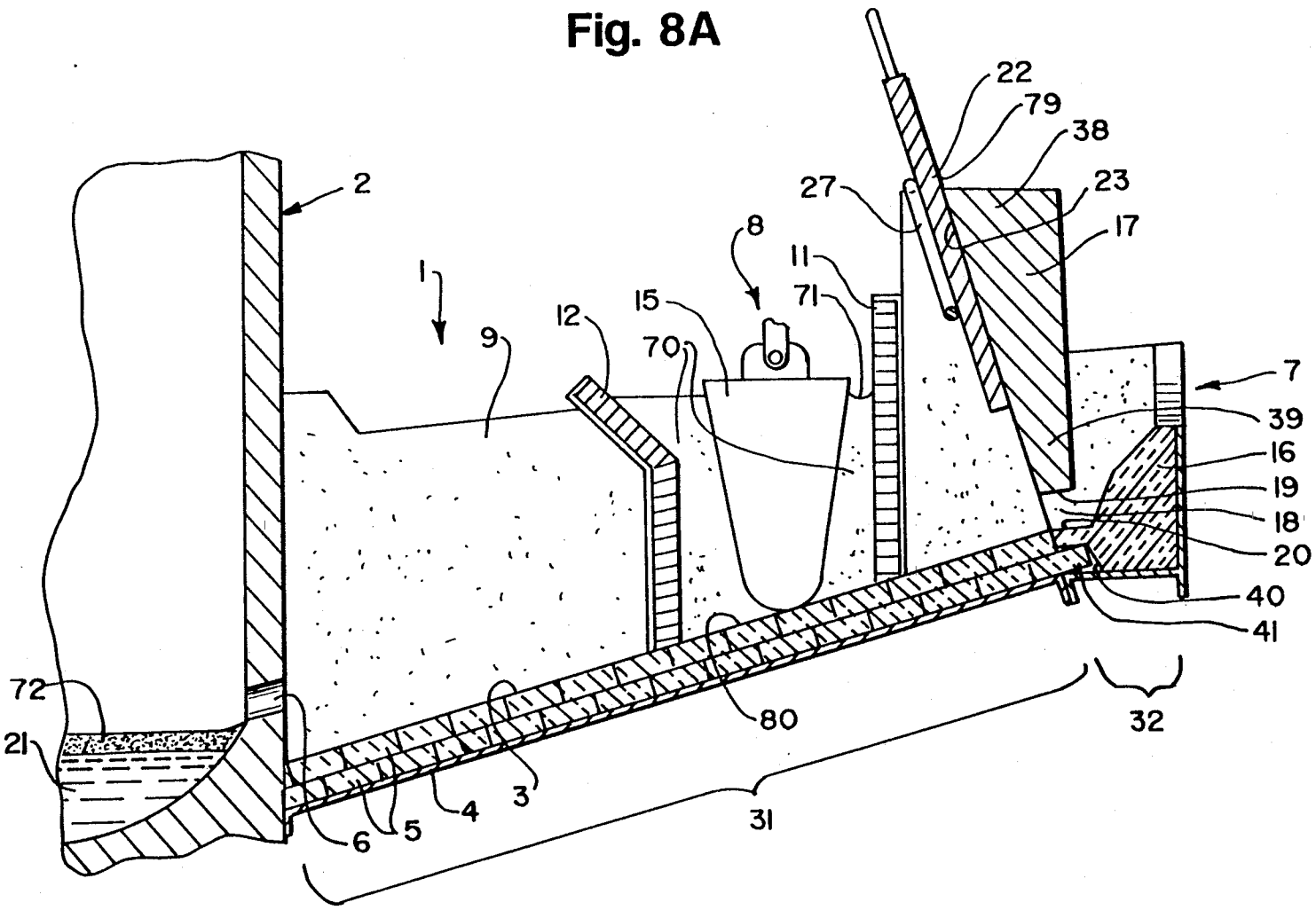
FIGS. 8A through 8D are a series of schematic, elevational, cross-sectional views of the slag control apparatus taken generally along the plane 8—8 in FIG. 3 to show the sequence of operation, with portions of the furnace and discharge passage gate means shown cut away and the lever arms, fulcrum members, heat shield means, hydraulic means, hydraulic lines, cooling lines, extension arm, counter-balance, and control means omitted for purposes of simplification.
Figure 8B:
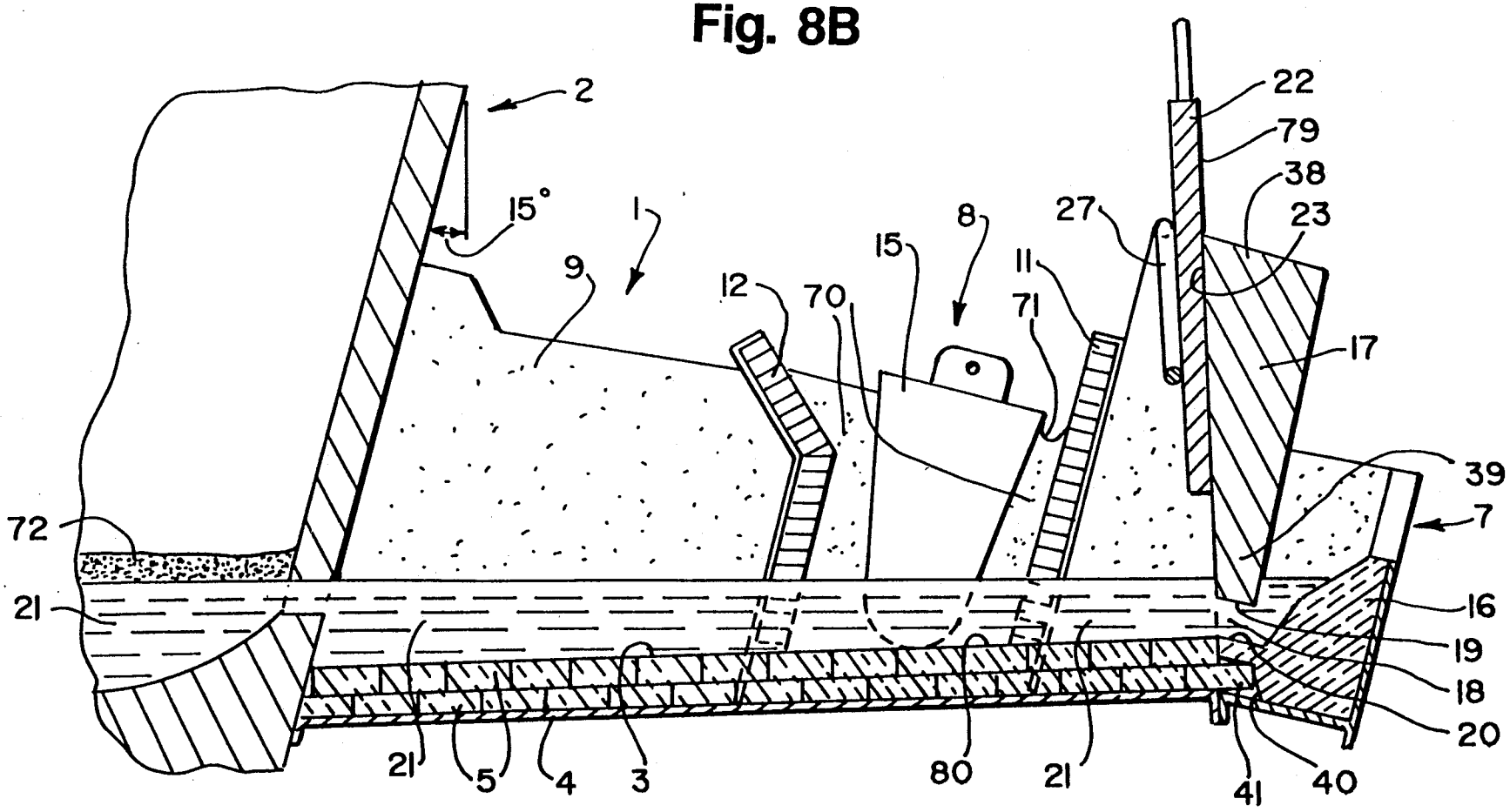
Figure 8C:
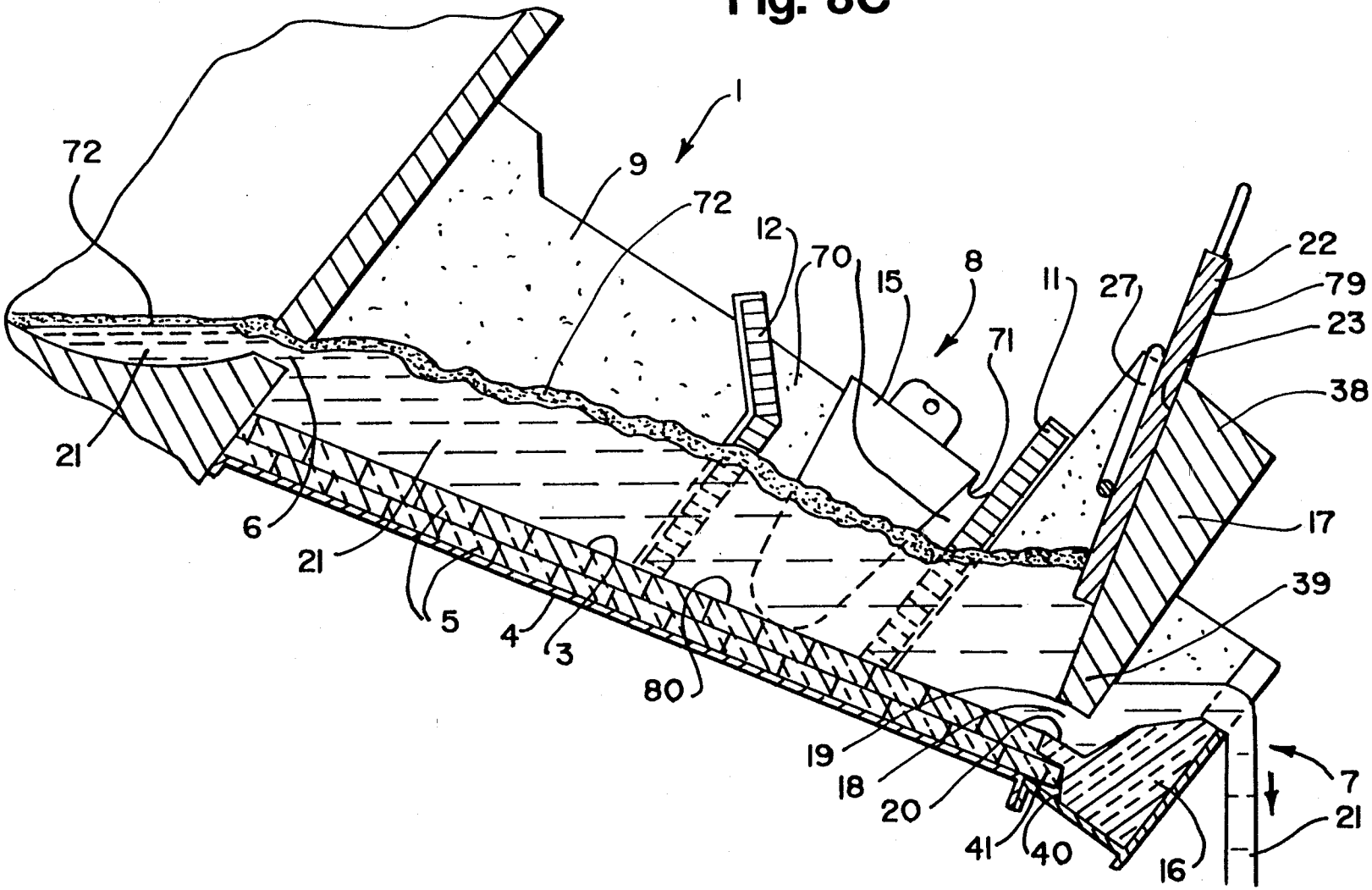

A retaining means 27 is mounted adjacent the discharge passage gate means 22 to retain the gate means 22 in close proximity with the inner face 23 of the dam, as shown in FIGS. 2, 3, 4 and 8A through 8D. While any number of devices would suffice, the retaining means 27 is preferably a U-shaped steel bar, as shown in FIG. 2. Each side 28 of the retaining bar is connected to an adjacent portion 29 of the side wall of the discharge trough means, as shown in FIGS. 2 and 3. The bottom of the U extends downwardly to guide and support the middle portion of the discharge passage gate means 22 when the discharge passage gate means 22 is in the raised, open position as shown in FIGS. 8A through 8C.

The top of the dam 17 preferably extends upwardly at least as high as the side walls 9 of the discharge trough means 1. However, it is preferred that the top of the dam 17 extend above the normal height of the adjacent portions 29 of the side walls 9 of the discharge trough means 1 and that the adjacent portion 29 of the side walls of the discharge trough means 1 be built up above their normal height in the vicinity of the dam, as seen in FIGS. 1 and 2. The extra height in the dam 17 and adjacent portions 29 of the side walls 9 of the discharge trough means 1 function to contain any splashing of the molten metal and slag in the discharge trough means 1.

While the entire discharge trough means, dam and weir may be unitary, i.e., one continuous, undivided structure, it is preferable to divide the discharge trough means into an inner trough portion 31 and an outer trough portion 32, as seen in FIGS. 1, 2, 3 and 8A. The inner trough portion 31 is permanently affixed to the furnace. The outer trough portion 32 contains the dam 17 and the weir 16, and defines the discharge passage 18.

The outer trough portion 32 is separate and detachable from the inner trough portion 31. The outer trough portion is connected to the inner trough portion by connecting means, such as bolts, which connect the peripheral flanges 33 extending from the periphery of the inner and outer trough portions as seen in FIGS. 1, 2, 6 and 7.

Figure 7:
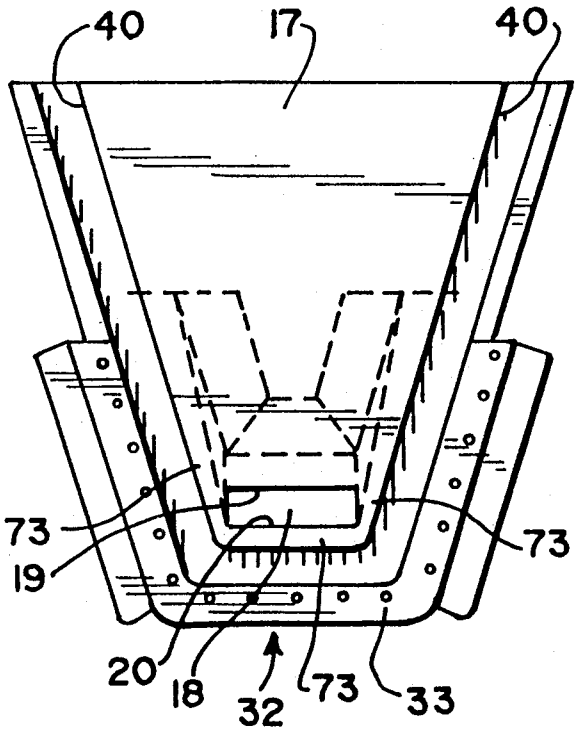
FIG. 7 is an end view of the outer trough portion taken generally along the plane 7—7 in FIG. 6.
Figure 6:
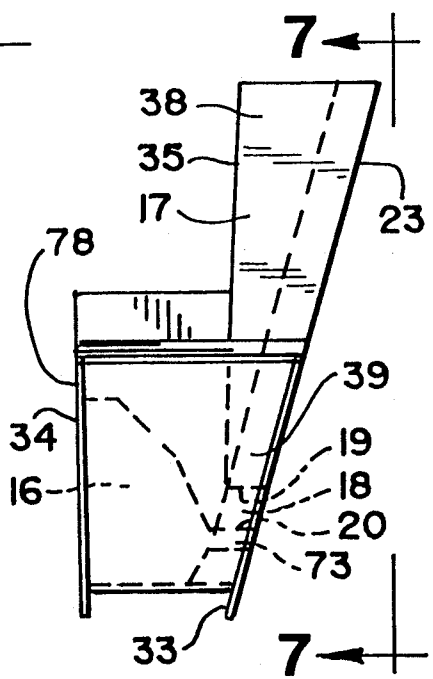
FIG. 6 is a side view of the outer trough portion taken generally along the plane 6—6 in FIG. 5.

Preferably, the outer trough portion 32 is a unitary block of refractory wherein an end wall portion defines the weir 16, a central wall portion defines the dam 17, and a peripheral portion 73 defines a part of the discharge trough means 1 as shown in FIGS. 6 and 7.

The outer trough portion 32 is made by placing refractory material into a steel shell 78 which functions as a mold as seen in FIGS. 1, 2, 4, 5 and 6. The peripheral flanges 33 extend laterally from the shell 78. Preferably, the refractory material is approximately 90% alumina or magnesite.

It is expedient to orient the outer face 34 of the weir and the outer face 35 of the dam in a generally vertical plane, while the inner face 23 of the dam is oriented in a plane which is approximately 15° from vertical in order to line up with the face of the distal end 37 of the inner trough portion, which is also at an angle of approximately 15° from vertical, as seen in FIGS. 4 and 6.

Since the outer face 35 of the dam is vertical and the inner face 23 of the dam is 15° from vertical, the top portion 38 of the dam will be thicker than the bottom portion 39 of the dam as seen in FIGS. 4, 6 and 8A through 8D.

The discharge passage 18 is located adjacent the bottom portion 39 of the dam as seen in FIGS. 4, 6 and 8A through 8D. It is surrounded by at least 2 to 8 inches, preferably 3 inches, of refractory, because the refractory will wear away and the discharge passage will gradually open up during successive pours.

A groove 40 on the inner face 23 of the dam 17 extends along the bottom edge and two side edges of the inner face of the dam as seen in FIGS. 3, 7 and 8A through 8D. The groove 40 is oriented to match a corresponding tongue portion 41 projecting outwardly from the distal end of the inner trough portion 31, as seen in FIGS. 3 and 8A.

The tongue portion 41 may be an extension of any portion of the inner trough portion 31, or it may be a separate piece which is connected to the inner trough portion 31. Preferably, the tongue portion 41 is an extension of the working lining of refractory brick which lines the discharge trough means. Preferably, this lining is 3 inches thick, corresponding to the thickness of standard refractory brick. Therefore, the corresponding groove 40 in the inner face 23 of the dam is at least 5 inches wide to accommodate the tongue portion.

Both the slag gate means 15 and the discharge passage gate means 22 are pivotally suspended from lever arms 26 and 43, as seen in FIGS. 1, 2, 3 and 4. The lever arms extend between each gate and hydraulic actuator means 44 and 45 as seen in FIG. 4. The lever arms pivot on fulcrum members 46 and 47 as seen in FIGS. 2 and 3. The fulcrum members are mounted in fulcrum supports 74 and 75.

The hydraulic actuator means 44 and 45 move the lever arms up and down, and thereby cause the attached gates to move up and down.

The hydraulic actuator means 44 and 45 are protected with heat shield means 48 and 49 mounted nearby as seen in FIGS. 2, 3 and 4. The heat shield means 48 and 49 protect the hydraulic actuator means 44 and 45 from heat which radiates from the molten steel.

The heat shield means 48 and 49 may be constructed in a variety of ways from suitable materials. In the illustrated embodiment, each heat shield means 48 and 49 is constructed from heavy-duty pipe, with the appropriate cut-outs 50 and 51 for permitting insertion and movement of the lever arms and hydraulic actuator means, as seen in FIGS. 2 and 4.

Additionally, a cooling means, such as a flow of air 52 supplied by air lines 53, may be directed inside the heat shields 48 and 49 for cooling the hydraulic actuator means 44 and 45 as shown in FIG. 4.

The lever arm 43 for the slag gate means 15 has an extension arm 54 extending past the heat shield means 49 as seen in FIGS. 2 and 4. A counter-balance 55 is connected to the extension arm as seen in FIG. 4. This counter-balance aids the hydraulic actuator means 45 in actuating the lever arm 43 to lift the slag gate means 15.

The hydraulic actuator means 44 and 45 for the lever arms 26 and 43 are remotely controlled by a conventional control means 56, as shown schematically in FIG. 4. The control means 56 controls the operation of the hydraulic pumps 57 which pump hydraulic fluid through hydraulic lines 58 to the hydraulic actuator means. Also, the control means 56 controls the means for tilting the tilting furnace 2. Thus, the operator will use the control means 56 to coordinate the tilting of the furnace 2 with the operation of the discharge passage gate means 22 and slag gate means 15.

Figures 9, 10, 11:
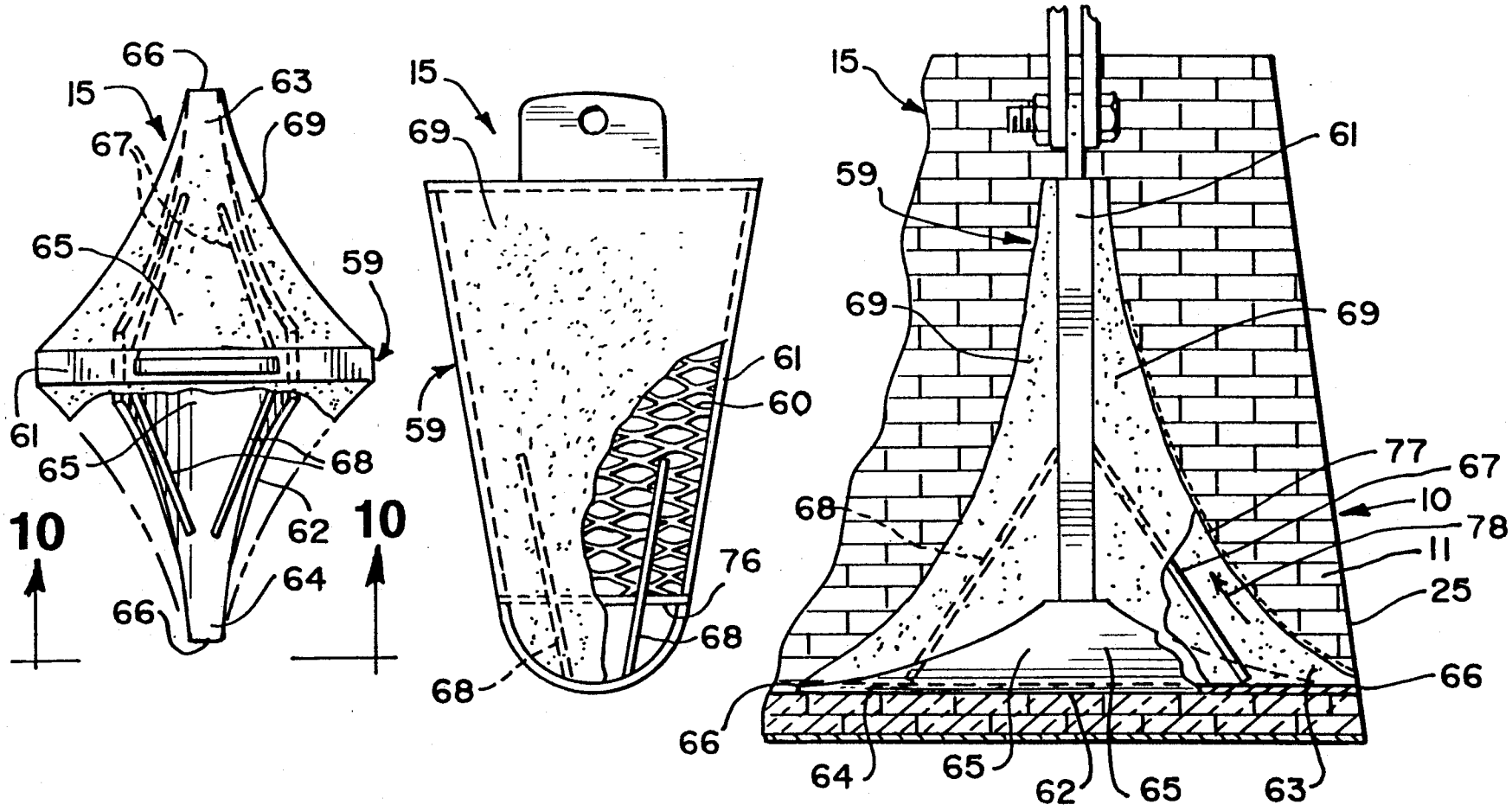
FIG. 9 is an enlarged top view of the slag gate means taken generally along the plane 3—3 in FIG. 2 with the refractory coating shown cut away in the lower portion of the drawing to illustrate interior detail and the slag chute omitted for purposes of simplification.
FIG. 10 an end view of the slag gate means taken generally along the plane 10—10 in FIG. 9 with the refractory coating shown cut away in the lower right portion of the drawing to illustrate interior detail.
FIG. 11 is a fragmentary, side elevational view of the slag gate means in the slag chute taken generally along the plane 11—11 in FIG. 3 with part of the refractory coating of the slag gate means shown cut away in the lower right corner of the drawing to illustrate interior detail.

As seen in FIGS. 9, 10 and 11, the slag gate means 15 has a substantially planar wall 59 which forms the core of the gate. The planar wall 59 is constructed from a sheet of expandable metal 60 stretched between a frame 61. A scalloped, half-section of large diameter pipe 62 is connected to the bottom 76 of the frame 61 to form the bottom of the slag gate. The pipe will extend in opposite directions from the planar wall to form a first spike means 63 and a second spike means 64. Each spike means tapers from a base 65 to a point 66, with the base being next to the frame 61 and the point extending perpendicularly away from the frame.

A first pair of diagonal reinforcing bars 67 extend between, and are fixed to, the expandable metal 60 and the first spike means 63. Similarly, a second pair of diagonal reinforcing bars 68 extend between, and are fixed to, the expandable metal 60 and the second spike means 64. The reinforcing bars 67 and 68 provide a rigid support between the expandable metal 60 and the spike means 63 and 64.

A refractory coating 69 is placed over the expandable metal 60, the reinforcing bars 67 and 68, and the upper surface of the spike means. This refractory coating defines a unitary cover over the entire slag gate means 15.

Before the slag gate means 15 is placed in the slag chute, a thin (approximately ½ inch) layer of sand or a granular refractory mixture is spread across the bottom of the slag chute 10 in the area where the slag gate means 15 will rest. Then, the slag gate means 15 is placed in the slag chute 10, adjacent the lateral opening 8 in the side wall 9 of the discharge trough means 1, as seen in FIG. 3.

The slag gate means 15 is oriented in the slag chute so that the first spike means 63 extends inwardly, toward the discharge trough means 1, and the second spike means 64 extends outwardly, away from the discharge trough means as seen in FIG. 3. The point 66 of the first spike means extends to, but not beyond, the inner surface 25 of the adjacent side wall 9 of the discharge trough as seen in FIGS. 3 and 11. Thus, the point 66 of the first spike means 63 is approximately flush with the inner surface 25 of the side wall 9 discharge trough means 1.

The width of the slag gate means 15 is less than the width of the slag chute 10 as seen in FIG. 4. When the slag gate means 15 is placed in the slag chute 10, the slag gate means 15 is centered across the width of the slag chute 10. There is a space between the side of the slag gate means 15 and the side wall of the slag chute 10 on each side of the slag gate means 15. Each space is filled with sand 70.

The space between the slag gate means 15 and the outer side wall 11 of the slag chute 10 is filled with sand or other granular refractory mixture 70 from the bottom 13 of the slag chute 10 to within approximately 10 inches of the top of the slag gate means 15 as seen in FIGS. 4 and 8A through 8D. Thus, a slot or viewing aperture 71, defined by the space between the slag gate means and the slag chute, is formed. The bottom of the slot is above the level of the bottom edge 80 of the lateral opening 8, as seen in FIGS. 4 and 8A through 8D. This viewing aperture 71 allows the operator to get a better view of the inside of the discharge trough means 1.

After the spaces between the sides of the slag gate means 15 and the side walls 11 and 12 of the slag chute 10 are filled with sand 70, the slag gate means 15 is back-filled with a mixture consisting of sand, clay and a binder material (not illustrated). A material sold under the trade name Chrismix, sold by Chrisman Sand Co. of Portage, Ind., U.S.A., works for this purpose. The Chrismix material is placed over the sand 70 and forms a thin (up to ½ inch) shell over the sand 70 in these spaces. This shell prevents the sand 70 in these spaces from dislodging during a tap, until such time as the slag gate means 15 is lifted.

Before the tap begins, the tilting furnace 2 is in the upright position a shown in FIG. 8A. The slag gate means 15 in the lowered, closed position and the discharge passage gate means 22 in the raised, open position. Molten steel 21 and floating slag 72 are in the furnace. The tap hole 6 is entirely above the level of the molten steel and floating slag.

The tap begins by tilting the furnace 2 sufficiently in order to lower the tap hole 6 to a level well below the level of the floating slag 72, as seen in FIG. 8B. Thus, molten metal 21 goes through the tap hole 6 while floating slag 72 remains inside the furnace. As the molten metal 21 drains from the furnace 2, the operator increases the tilt of the furnace in order to keep the floating slag 72 above the level of the tap hole 6.

When the molten metal 21 initially flows into the discharge trough means 1, it will fill the bottom of the discharge trough means, as shown in FIG. 8B. The weir 16 at the open discharge end 7 of the discharge trough means 1 initially retains the molten metal 21 in the discharge trough means and causes the molten metal to pool in the discharge trough means until the depth of the pool exceeds the height of the top of the weir 16.

As the operator increases the tilt of the furnace, and the depth of the molten metal 21 in the discharge trough means 1 exceeds the height of the top of the weir 16, the molten metal will flow over the weir 16, as seen in FIG. 8C.

As discussed above, the molten metal 21 flowing through the tap hole 6 will tend to vortex. The vortexing of the molten metal 21 will draw interface slag from the floating furnace slag 72 down into the tap hole 6 where the interface slag 72 will flow with the molten metal 21 through the tap hole 6 and into the discharge trough means 1, as seen in FIG. 8C.

The interface slag which escapes into the discharge trough means, separates from the molten metal and rises to the surface to form a layer of floating slag in the discharge trough means 1. Since the weir 16 maintains a minimum depth of flow of molten metal 21 in the discharge trough means 1, the slag 72 floats at a level which is above the level of the discharge passage 18, as seen in FIG. 8C.

While vortexing occurs as molten metal 21 flows through the tap hole 6, vortexing does not occur as molten metal flows through the discharge passage 18. It is believed that the rectangular shape of the discharge passage inhibits and/or prevents significant vortexing.

During the tap, when the molten metal 21 is flowing down in the discharge trough means 1, the operator may view the discharge trough means from a vantage point which allows him to see the slag chute 10, slag gate means 15, and side of the discharge trough means 1. The viewing aperture 71 between the slag gate means 15 and the outer side wall 11 of slag chute 10 will aid the operator in seeing how much molten metal and floating slag is in the discharge trough means during the course of the tap. He can adjust the tilt of the furnace 2 to control the amount of molten metal 21 and slag 72 which is flowing through the tap hole 6 and into the discharge trough means and thereby control the level of molten metal and slag in the discharge trough means 1. If the depth of molten metal 21 and slag 72 in the discharge trough means 1 becomes too great, then the operator can slow down, or temporarily stop or reverse, the tilting of the furnace 2.

Figure 8D:
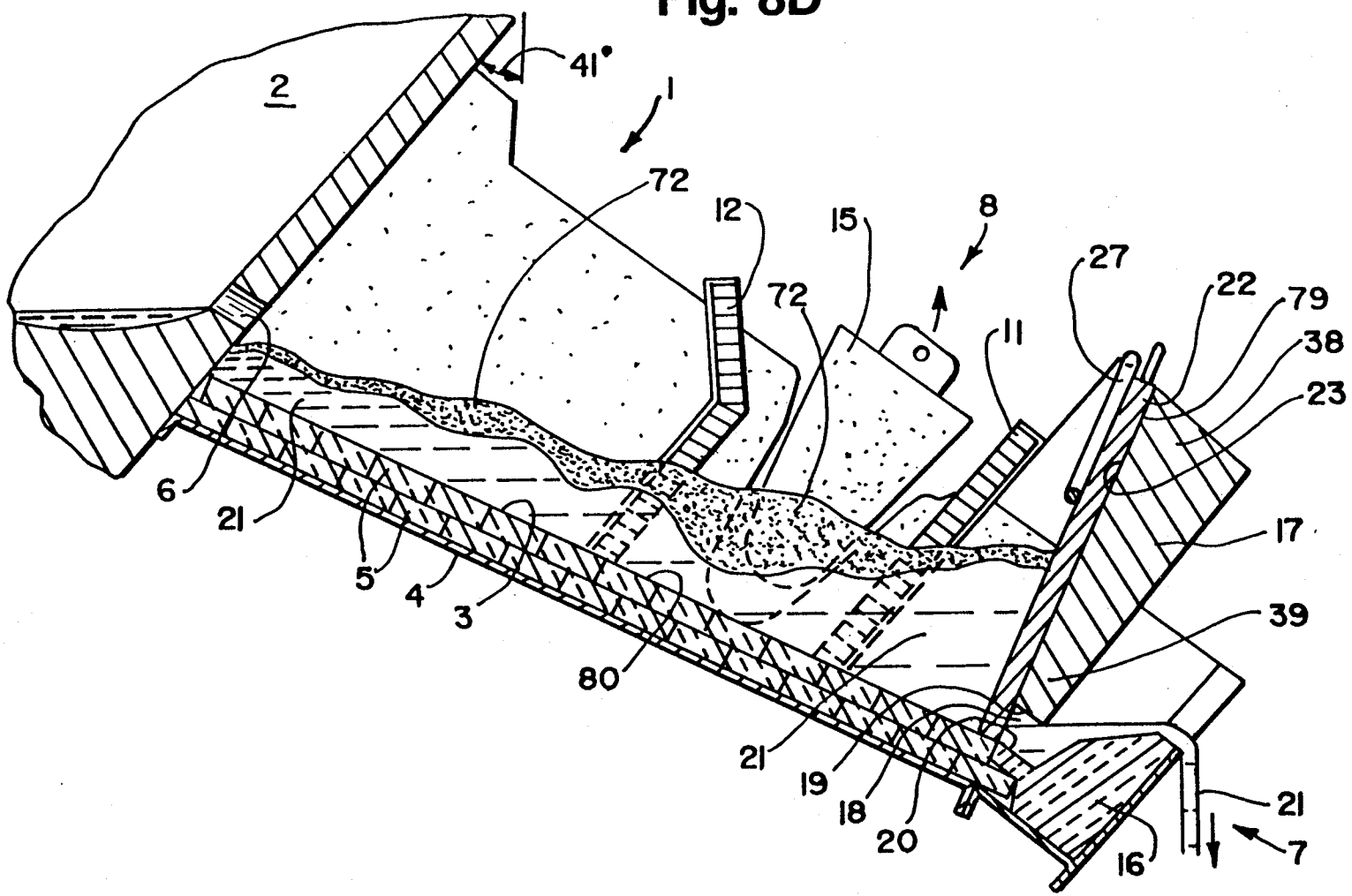

When the molten metal 21 has fully or substantially drained from the furnace 2, then the remaining floating slag 72 in the furnace will flow through the tap hole and into the discharge trough means This will usually begin to occur when the furnace 2 is tilted to approximately 35° to 38° from vertical, in a conventional electric arc furnace which tilts from 0° to 41° from vertical. As the furnace continues to tilt to 41° from vertical, this flow of slag 72 through the tap hole 6 will greatly increase the amount of slag in the discharge trough means 1, as depicted in FIG. 8D. This flow of slag 72 will be apparent to the operator, who will see an increase in the amount of floating slag in the discharge trough means.

When the operator determines that the molten metal has fully or substantially drained from the furnace 2, and that floating slag 72 is building up in the discharge trough means 1, he will stop any further tilting of the furnace 2, and lower the discharge passage gate means 22 to the lowered, closed position, as seen in FIG. 8D. Alternatively, the operator may start closing the discharge passage gate means 22 when the furnace 2 is at approximately 38° from vertical, before the furnace is fully tilted.

At about this time, when the furnace is tilted to approximately 35° to 41°, the operator will lift the slag gate means 15 to the raised, open position, as seen in FIG. 8D. Alternatively, the operator may wait until the furnace is tilted to approximately 41° from vertical before starting the opening of the slag gate means 15.

Preferably, the operator will wait until the discharge passage gate means 22 is fully closed before opening the slag gate means 15. However, the discharge passage gate means 22 can be closed before, during, or after the opening of the slag gate means 15.

The discharge passage gate means 22 is variably moveable between the open and closed positions. Thus, it is adjustable to partially close the discharge passage 18 and control the flow rate through the discharge passage 18. By adjusting the flow rate, the operator can easily control the tap. In applications where it is desired to allow some slag 72 to flow through the discharge passage 18, the operator can control the flow of slag 72 which is permitted to go through the discharge passage 18 at the end of a tap.

If the operator opens the slag gate means 15 before closing the discharge passage gate means 22, then slag 72 will begin to flow through the lateral opening 8 and into the slag chute 10 while molten metal 21 is still flowing through the discharge passage 18. When enough slag 21 has flowed from the discharge trough means 1 and into the slag chute 10, the molten metal 21 may stop flowing through the discharge passage 18 if the furnace 2 is not tilted too far and/or the height of the weir 16 is sufficient.

When molten metal flows along an open runner or trough, a soft, semi-solid coating of cooled molten metal may coat the runner or trough. This coating is often called the runner "skull." During the course of a tap, this runner skull will form in the discharge trough means 1. Since the molten metal contacts the slag gate means 15, a "skull" coating 77 will form on the slag gate means 15, as shown in FIG. 11.

When the slag gate means 15 is lifted, the point of the first spike means 63 will tear the soft, "skull" coating 77. As the slag gate means 15 moves up, the coating 77 may tend to resist the upward movement of the slag gate means 15. In reaction, the bottom of the slag gate means 15 may tend to "slide" outwardly, away from the discharge trough means 1, in the direction of the arrow 78, as shown in FIG. 11.

The outward movement of the slag gate means 15 is resisted at the top of the gate by the connection to the lever arm. There is no corresponding connection at the bottom of the slag gate means. Hence, the bottom of the slag gate means tends to pivot outwardly as the slag gate means is raised.

The outward pivoting movement of the slag gate means is minimized by a counter-weight which extends outwardly from the bottom of the slag gate means. Preferably, the counter-weight is the second spike means 64 which is a mirror image of the first spike means 63. Thus, the slag gate means is reversible. If the first spike means 63 becomes worn, then the slag gate means 15 can be rotated 180° such that the second spike means 64 extends inwardly, toward the discharge trough means 1.

When the slag gate means 15 is opened, the sand and granular refractory seal between the slag gate means 15 and the slag chute 10 is broken. The molten metal 21 and floating slag 72 in the discharge trough means 1 will flow through the lateral opening 8, under and around the slag gate means 15, and into the slag chute 10. This flow will carry the sand and granular refractory along with the flow. The slag 72 is directed by the slag chute 10 into a preselected deposit region, such as a container or a containment area below the furnace (not shown).

Preferably, the operator will allow most of the molten steel 21 in the discharge trough means 1 to flow through the discharge passage 18 before closing the discharge passage gate means 22. Thus, most of the remaining material in the discharge trough means 1 consists of slag 72.

When the operator opens the slag gate means 15, he may begin to return the furnace 2 to the upright position. As he does so, the slag 72 in the discharge trough means will continue to drain from the discharge trough means 1, through the lateral opening 8, into the slag chute 10.

Thus, the apparatus and method of this invention controls slag in a tap discharge of molten metal and floating slag by a novel process of damming and retaining the slag when it is in the discharge trough means, while allowing the molten metal to flow out of the discharge trough means. By using the combination of a weir, dam, discharge passage gate means and a slag gate means for closing a lateral opening in the discharge trough means, all moveable with the tilting furnace and discharge trough means, this invention effectively separates and controls slag in a tap discharge from a tilting electric arc furnace which is deposited on a ladle.

What is claimed is:

1. A method for controlling the amount of slag in a tap disclosure of molten metal and floating slag from a tap hole of a tilting furnace, said furnace having a discharge trough means mounted to, and extending outwardly from, said furnace below said tap hole for tilting with said furnace, said trough means defining an open discharge end and a lateral opening inwardly of said open discharge end, said method comprising the steps of:

(a) sufficiently tilting said furnace end and trough means to discharge said molten metal and slag from said tap hole and into said trough means whereby said molten metal can flow under the influence of gravity out of said trough means at said discharge end;

(b) damming said molten metal and slag and retaining said slag in said tilted trough means while permitting said molten metal to flow out of said trough means; and (c) discharging said retained slag through said lateral opening in said tilted trough to a location remote from said discharge end.

2. The method in accordance with claim 1 wherein step (a) includes increasing the angle of tilt of said furnace and trough during said discharge of said molten metal and slag in step (a).

3. The method in accordance with claim 1 wherein step (b) includes employing a weir across said trough means outwardly of said lateral opening to establish, for a selected angle of tilt of said furnace end trough, a minimum depth of said molten metal flow in a portion of said trough means.

4. The method in accordance with claim 1 in which step (b) includes providing a dam across said trough means between said lateral opening and said discharge end with at least one of said dam and said trough means defining a discharge passage for permitting the flow of said molten metal outwardly past said dam below the top of said dam; and step (a) includes tilting said furnace to maintain the level of said slag above the level of said discharge passage as said slag floats on said molten metal while said molten metal flows through said discharge passage and out of said trough means.

5. The method in accordance with claim 4 wherein a discharge passage gate means is operatively disposed adjacent said discharge passage for movement between (1) an open position for permitting the flow of said molten metal through said discharge passage and (2) a closed position for occluding flow through said discharge passage;

steps (a) and (b) include maintaining said discharge passage gate means sufficiently open to permit said flow of molten metal through said discharge passage; and said method includes the further step (d) of closing said discharge passage gate means to occlude said flow of said molten metal through said discharge passage.

6. The method in accordance with claim 5 wherein step (d) is effected before step (c).

7. The method in accordance with claim 5 in which step (d) is effected during step (c).

8. The method in accordance with claim 5 in which step (c) is continued after step (d).

9. The method in accordance with claim 1 wherein a slag gate means is operatively disposed adjacent said lateral opening for movement between (1) an open position for permitting the flow of slag from said trough means through said lateral opening and (2) a closed position for occluding flow through said lateral opening;

step (b) includes maintaining said slag gate means in said closed position for occluding flow through said lateral opening; and step (c) includes opening said slag gate means for permitting the flow of slag from said trough means through said lateral opening.

10. The method in accordance with claim 1 wherein a discharge passage gate means is operatively disposed adjacent said discharge passage for movement between (1) an open position for permitting the flow of molten metal through said discharge passage and (2) a closed position for occluding flow through said discharge passage;

a slag gate means is operatively disposed adjacent said lateral opening for movement between (1) an open position for permitting flow of slag from said trough means through said lateral opening and (2) a closed position for occluding flow through said lateral opening;

steps (a) and (b) include maintaining said discharge passage gate means sufficiently open to permit said flow of molten metal through said discharge passage;

steps (a) and (b) include maintaining said slag gate means in said closed position for occluding flow through said lateral opening;

step (c) includes opening said slag gate means to permit the passage of slag from said trough means through said lateral opening; and said method includes the further step (d) of closing said discharge passage gate means to occlude said flow of said molten metal through said discharge passage.

11. The method in accordance with claim 10 wherein step (a) includes increasing the angle of tilt from a non-discharging, vertical, upright position to a discharging position which is approximately 41° from said vertical, upright position.

12. The method in accordance with claim 11 wherein step (d) includes starting said closing of said discharge passage gate means when said furnace is at approximately 38° from said vertical, upright position.

13. The method in accordance with claim 11 wherein step (c) includes starting said opening of said slag gate means when said furnace is at approximately 41° from the vertical, upright position.

14. The method in accordance with claim 9 wherein step (a) includes increasing the angle of tilt from a non-discharging, vertical upright position to a discharging position which is approximately 41° from said vertical, upright position and step (c) includes starting said opening of said slag gate means when said furnace is approximately 35° to 41° from the vertical, upright position.

15. A method for controlling the amount of slag in a tap disclosure of molten metal and floating slag from a tap hole of a tilting furnace, said furnace having a discharge trough means mounted to, and extending outwardly from, said furnace below said tap hole for tilting with said furnace, said trough means defining an open discharge end and a lateral opening inwardly of said open discharge end, said method comprising the steps of:

(a) sufficiently tilting said furnace end and trough means to discharge said molten metal and slag from said tap hole and into said trough means whereby said molten metal can flow under the influence of gravity out of the trough means at the discharge end;

(b) establishing, for a selected angle of tilt of said trough and furnace, a minimum depth of molten metal flow in a portion of said trough means with a weir across said trough means outwardly of said lateral opening;

(c) damming the molten metal and slag flow between said weir and said lateral opening while permitting said molten metal to flow outwardly past said dam at a level below the top of said dam to retain said slag floating on top of said molten metal behind said dam; and (d) discharging said retained slag through said lateral opening.

16. The method in accordance with claim 1 wherein step (b) includes controlling the rate of flow of said molten metal and slag through said tap hole so as to control the level of said molten metal and slag in said tilted trough.

17. The method in accordance with claim 1 wherein step (b) includes controlling the rate of flow of said molten metal out of said trough means so as to control said damming.

18. A method for controlling the amount of slag in a tap disclosure of molten metal and floating slag from a tap hole of a tilting furnace, said furnace having a discharge trough means mounted to, and extending outwardly from, said furnace below said tap hole for tilting with said furnace, said trough means defining an open discharge end and a lateral opening inwardly of said open discharge end, said method comprising the steps of:

(a) sufficiently tilting said furnace end and trough means to discharge said molten metal and slag from said tap hole and into said trough means whereby said molten metal can flow under the influence of gravity out of said trough means at said discharge end;

(b) providing a fixed dam extending upwardly in said tilted trough means from an elevation in said molten metal below said slag to an elevation above said slag and then damming and retaining said molten metal and slag in said tilted trough means while permitting said molten metal to flow out of said trough means; and (c) discharging said retained slag through said lateral opening in said tilted trough to a location remote from said discharge end.

19. A method for controlling the amount of slag in a tap disclosure of molten metal and floating slag from a tap hole of a tilting furnace, said furnace having a discharge trough means mounted to, and extending outwardly from, said furnace below said tap hole for tilting with said furnace, said trough means defining an open discharge end and a lateral opening inwardly of said open discharge end, said method comprising the steps of:

(a) sufficiently tilting said furnace end and trough means to discharge said molten metal and slag from said tap hole and into said trough means whereby said molten metal can flow under the influence of gravity out of said trough means at the discharge end;

(b) establishing, for a selected angle of tilt of said trough and furnace, a minimum depth of molten metal flow in a portion of said trough means with a weir across said trough means outwardly of said lateral opening;

(c) providing a fixed dam extending upwardly in said tilted trough means from an elevation in said molten metal below said slag to an elevation above said slag between said weir and said lateral opening and then damming the molten metal and slag flow while permitting said molten metal to flow outwardly past said dam at a level below the top of said dam to retain said slag floating on top of said molten metal behind said dam; and (d) discharging the retained slag through said lateral opening.

* * * * *